US006749577B2

(12) United States Patent
Kume et al.

(10) Patent No.: US 6,749,577 B2
(45) Date of Patent: Jun. 15, 2004

(54) MASSAGE MACHINE

(75) Inventors: Masao Kume, Hirakata (JP); Kazuya Hiyamizu, Hirakata (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 61 days.

(21) Appl. No.: 10/067,339

(22) Filed: Feb. 7, 2002

(65) Prior Publication Data

US 2002/0138023 A1 Sep. 26, 2002

(30) Foreign Application Priority Data

Feb. 9, 2001 (JP) ..... 2001-033748

(51) Int. Cl.[7] ..... A61H 15/00

(52) U.S. Cl. ..... 601/99; 601/100; 601/102; 601/103; 601/116; 600/27

(58) Field of Search ..... 601/15, 46, 49, 601/51–52, 56–60, 70, 84, 86, 90, 98, 99, 100, 102, 103, 115, 116; 600/26–28; 128/905

(56) References Cited

U.S. PATENT DOCUMENTS 5,304,112 A * 4/1994 Mrklas et al. ..... 601/15
5,792,047 A * 8/1998 Coggins ..... 600/300
5,792,080 A 8/1998 Ookawa et al. ..... 601/115
5,993,401 A * 11/1999 Inbe et al. ..... 601/46
6,443,917 B1 * 9/2002 Canto ..... 601/99
6,540,701 B1 * 4/2003 Inada ..... 601/99
6,554,763 B1 * 4/2003 Amano et al. ..... 600/26
6,629,939 B2 * 10/2003 Jikiba et al. ..... 601/99

FOREIGN PATENT DOCUMENTS

JP 11-19150 1/1999
JP 2000-167001 6/2000

OTHER PUBLICATIONS

European Search Report dated Nov. 21, 2003.

* cited by examiner

*Primary Examiner*—Denton D. DeMille
*Assistant Examiner*—Quang D. Thanh
(74) *Attorney, Agent, or Firm*—Armstrong, Kratz, Quintos, Hanson & Brooks, LLP.

(57) ABSTRACT

A massage machine is provided which is adapted to give a suitable massage in accordance with the degree of stiffness or degree of relaxation of the person to be massaged, based on the results obtained by measuring the body outline of the person and physiological data as to the person such as the pulse rate and skin temperature. The massage machine measures the body outline of the person, and measures physiological data concerning the person which is produced by massaging the person. The body outline of the person, such as the position of the neck, shoulder, back and waist is measured, and the measured physiological data is used to discriminate between the part of great stiffness and the part of low stiffness so as to give an effective massage in accordance with the degree of stiffness.

5 Claims, 13 Drawing Sheets

| MEASURING ITEM | | AREA A | AREA B | AREA C | AREA D |
|---|---|---|---|---|---|
| PULSE | SENSITIVITY LEVEL T | 0 | 2 | 0 | 2 |
| | SENSITIVITY LEVEL S | 2 | 2 | 1 | 2 |
| | STIFFNESS LEVEL U | 2 | 4 | 1 | 4 |
| SKIN TEMP. (RECIPROCAL) | SENSITIVITY LEVEL T | 2 | 2 | 1 | 0 |
| | SENSITIVITY LEVEL S | 1 | 2 | 1 | 1 |
| | STIFFNESS LEVEL U | 3 | 4 | 2 | 1 |
| SKIN ELECTRICAL RESISTANCE (RECIPROCAL) | SENSITIVITY LEVEL T | 0 | 2 | 0 | 1 |
| | SENSITIVITY LEVEL S | 3 | 3 | 1 | 0 |
| | STIFFNESS LEVEL U | 3 | 5 | 1 | 1 |
| | OVERALL STIFFNESS LEVEL V | 8 | 13 | 4 | 6 |

MASSAGE MACHINE

FIELD OF THE INVENTION

The present invention relates to massage machines adapted to give effective massage in accordance with the figure or form of the person to be massaged and physiological data as to the person, such as pulse, skin temperature, etc.

BACKGROUND OF THE INVENTION

FIG. 1 shows a massage machine 10 of the chair type which is adapted to give massage to the person as seated on a chair 11. The machine has massage members or fingers 40, 40 upwardly and downwardly movably provided inside a backrest 13 of the chair 11 for performing massage on the part of the person from his neck to back or to the waist by tapping, kneading, rolling or a combination of such movements.

With usual massage machines of the chair type, the person to be massaged manually selects a tapping, kneading or other massaging operation or selects a massage program comprising a combination of different massage movements for the machine to give massage to the person.

To produce an improved massage effect, it is desirable to give massage with a suitable intensity in accordance with the degree of stiffness of the part to be treated or with the degree of relaxation, for example, to give a strong massage to the part of great stiffness and to give a weak massage to the part of low stiffness. If a weak massage is performed on a very stiff part or a strong massage is given to the part of low stiffness, the person treated fails to feel massaged satisfactorily or feels a pain or discomfort.

However, the part to be massaged differs from person to person or the particular part (e.g., the shoulder) to be massaged is likely to differ in its position relative to the backrest depending on the body outline of the person or the way he is seated on the chair.

To give the person an effective massage, therefore, it becomes necessary to realize the figure or form of the person, i.e., the position of the neck, shoulder, back, waist or the like, and to locate a part of great stiffness or part of low stiffness, or a relaxed part or part not relaxed. However, none of the conventional massage machines are adapted to give massage in conformity with the body outline or form of the person to be massaged and the degree of stiffness or relaxation.

An object of the present invention is to provide a massage machine which is adapted to give a suitable massage in accordance with the degree of stiffness or relaxation based on the measurements of the body outline or form of the person to be massaged and of physiological data such as the pulse rate and skin temperature of the person.

SUMMARY OF THE INVENTION

To overcome the above problem, the present invention provides a massage machine comprising massage members for performing massage along the body of the person to be massaged, and control means for controlling the movement of the massage members, the massage machine further comprising means for measuring the body outline of the person, and means for measuring physiological data concerning the person and produced by massaging the person, the body outline measuring means and the physiological data measuring means being electrically connected to the control means. The body outline measuring means detects the form of the body of the person, for example, the position of the neck, shoulder, back or waste, while the physiological data measuring means detects a part of great stiffness, a part of low stiffness or the degree of relaxation for the machine to give an effective massage in accordance with the degree of stiffness or relaxation.

The body outline measuring means measures angular variations and pressure variations of the massage members and detects the particular part of the body of the person where the massage members are in contact with the body.

The measurements obtained by the body outline measuring means are transmitted to the control means.

The physiological data measuring means measures, for example, the pulse rate, skin temperature and/or electrical resistance of the skin to obtain physiological data which varies in response to the massage given to the person.

A difference occurs in the physiological data detected from the person between a part of high stiffness and a part of low stiffness, or between a relaxed part and an unrelaxed part.

The physiological data is measured by the physiological data measuring means and the measurements are sent to the control means.

Based on the data obtained from the body outline measuring means and the physiological data measuring means, the control means judges, for example, what part of the body of the person is stiff and what part of the body is not stiff, and controls the massage members to give a massage to a particular part of the body while changing the kind of massage movement and varying the intensity, speed and duration of massage in accordance with the position of the part to be treated and with the degree of stiffness.

The massage machine of the present invention is adapted to give an appropriate massage in accordance with the degree of stiffness and the degree of relaxation of the body part of the person to be massaged based on the data obtained from the body outline measuring means and the physiological data measuring means.

For example, the massage members or fingers are so controlled by the control means as to give an intense massage to a part of great stiffness and a weak massage to a part of low stiffness. This eliminates the likelihood that the part of great stiffness will be given an insufficient weak massage, or the part of low stiffness an uncomfortable intense massage as experienced with the prior art.

The present invention therefore achieves improvements in the therapeutic effect and comfort to be given by massage.

DESCRIPTION OF THE PREFERRED EMBODIMENT

Figure 1:
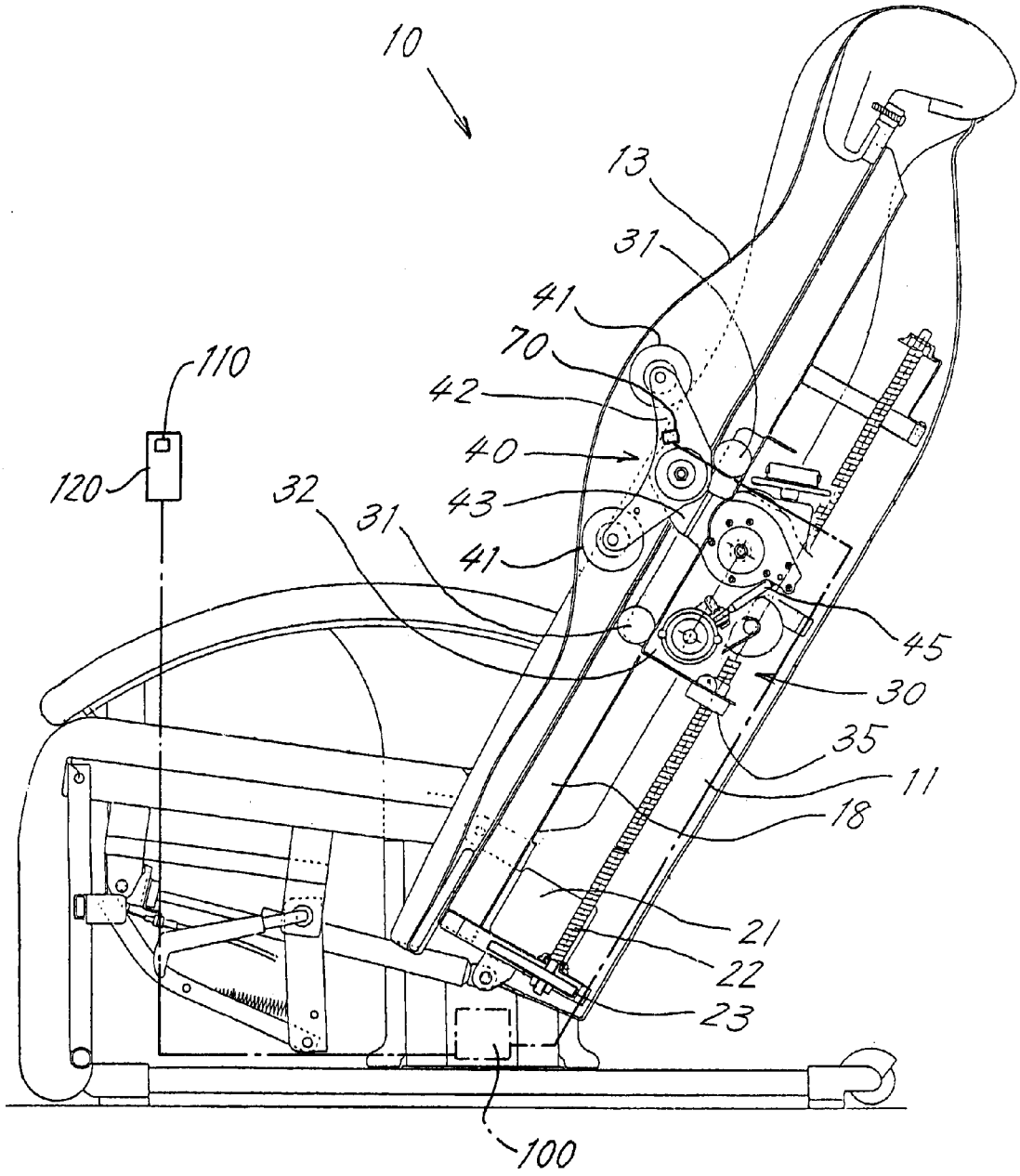
FIG. 1 is a view in section of a massage machine of the chair type.

FIG. 1 shows a massage machine of the invention which comprises body outline measuring means 70 for measuring body parts of the person to be massaged, and physiological data measuring means 110 for measuring the degree of stiffness or the degree of relaxation from physiological data as to the person. After giving a massage (hereinafter referred to as "preliminary massage") for measuring physiological data, the machine subsequently performs a massage operation (hereinafter referred to as "main massage").

The construction of the massage machine 10, the body outline measuring means 70 and the physiological data measuring means 110 will be described below in this order.

Massage Machine 10

The massage machine 10 comprises a massage unit 30 provided in a backrest 13 of a chair 11 upwardly or downwardly movably. The chair 11 comprises inside thereof pipes, frames or plates of metal which are connected together and surrounded by pad fabrics and cushions.

A pair of guide rails 18, 18 extending upward or downward in parallel are arranged in parallel inside the backrest 13. A screw rod 22 is rotatably provided in parallel to the guide rails 18, 18. A lift motor 21 is disposed in a lower portion of the backrest 13. The screw rod 22 is coupled to the lift motor 21 by a belt 23 and is rotated forward or reversely by driving the motor 21 to move the massage unit 30 upward or downward along the guide rails 18. The lift motor 21 has its operation controlled by the control means 100 to be described later.

Massage Unit 30

Figure 2:
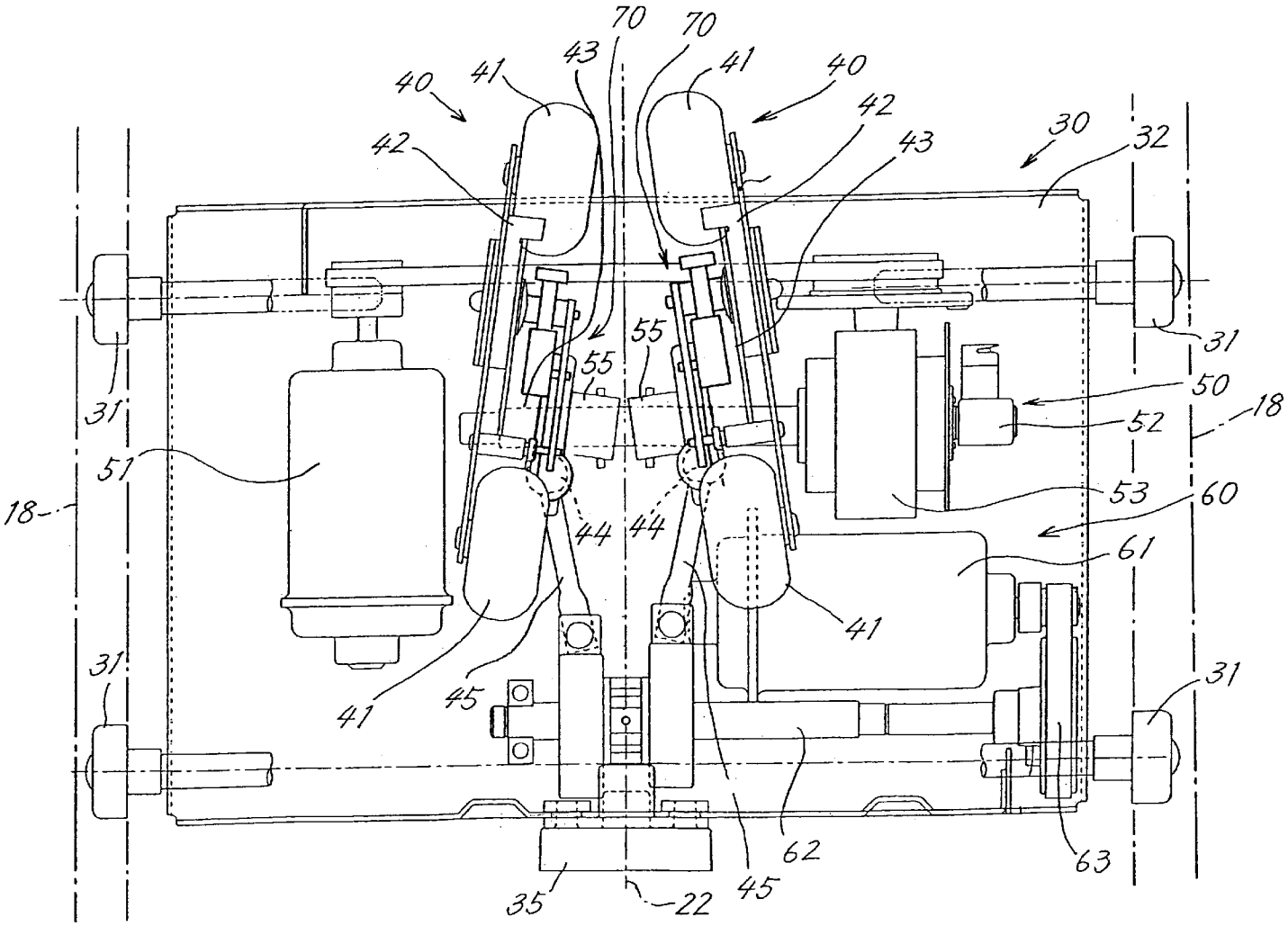
FIG. 2 is a front view of a massage unit of the invention.

With reference to FIG. 2, the massage unit 30 comprises as mounted on a chassis 32 massage members or fingers 40, 40, and kneading means 50 and tapping means 60 which operate the members 40, 40. Rollers 31, 31 are arranged on left and right sides of the chassis 32, in engagement with the guide rails 18, 18. A screw sleeve 35 screwed on the screw rod 22 is mounted on the chassis 32. When the screw rod 22 is rotated, the massage unit 30 is moved upward or downward along the guide rails 18, 18 by the thrust of the screw.

Figure 3:
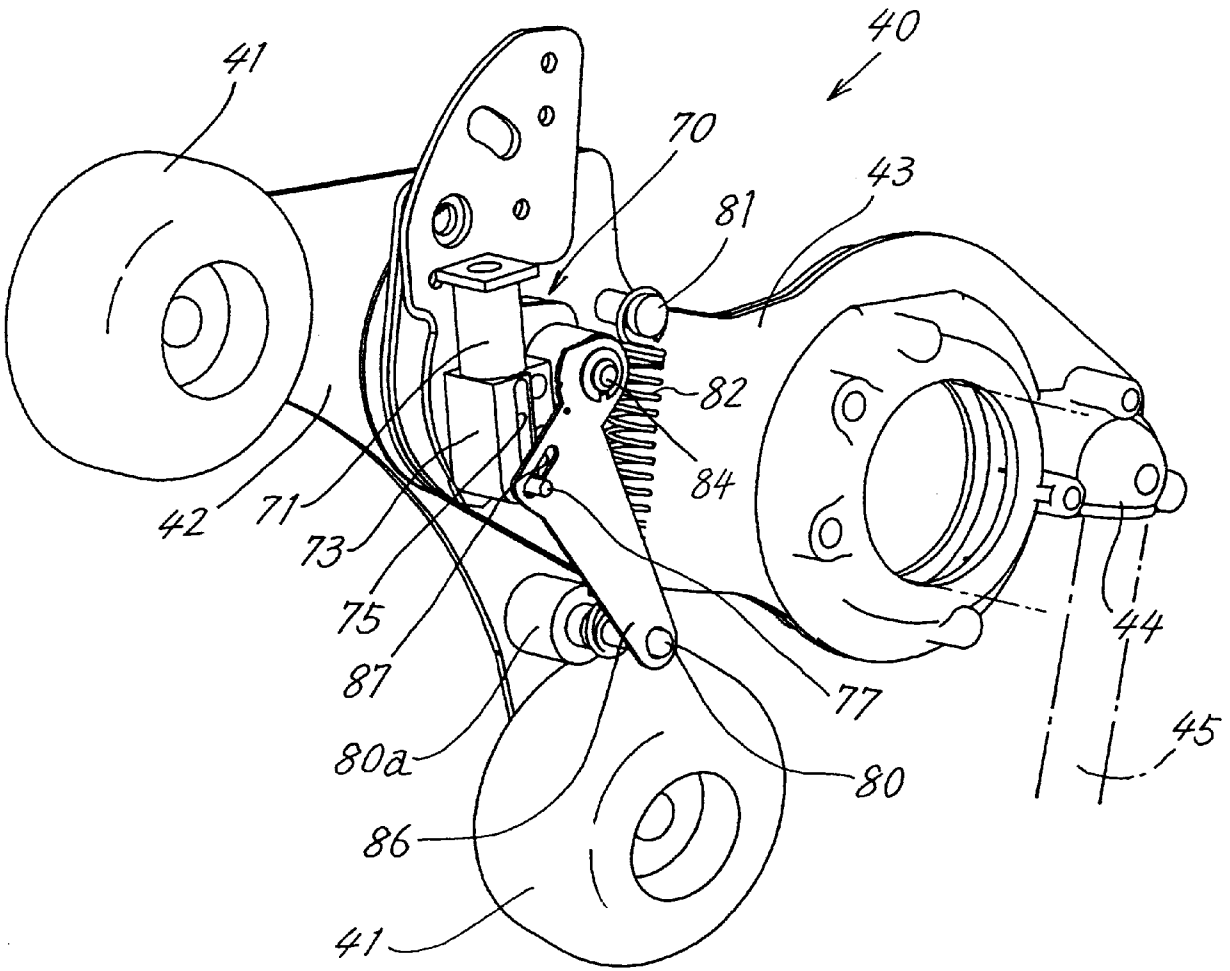
FIG. 3 is a perspective view showing one of massage members of the present invention on an enlarged scale, with a massage arm in an forwardly inclined posture.
Figure 4:
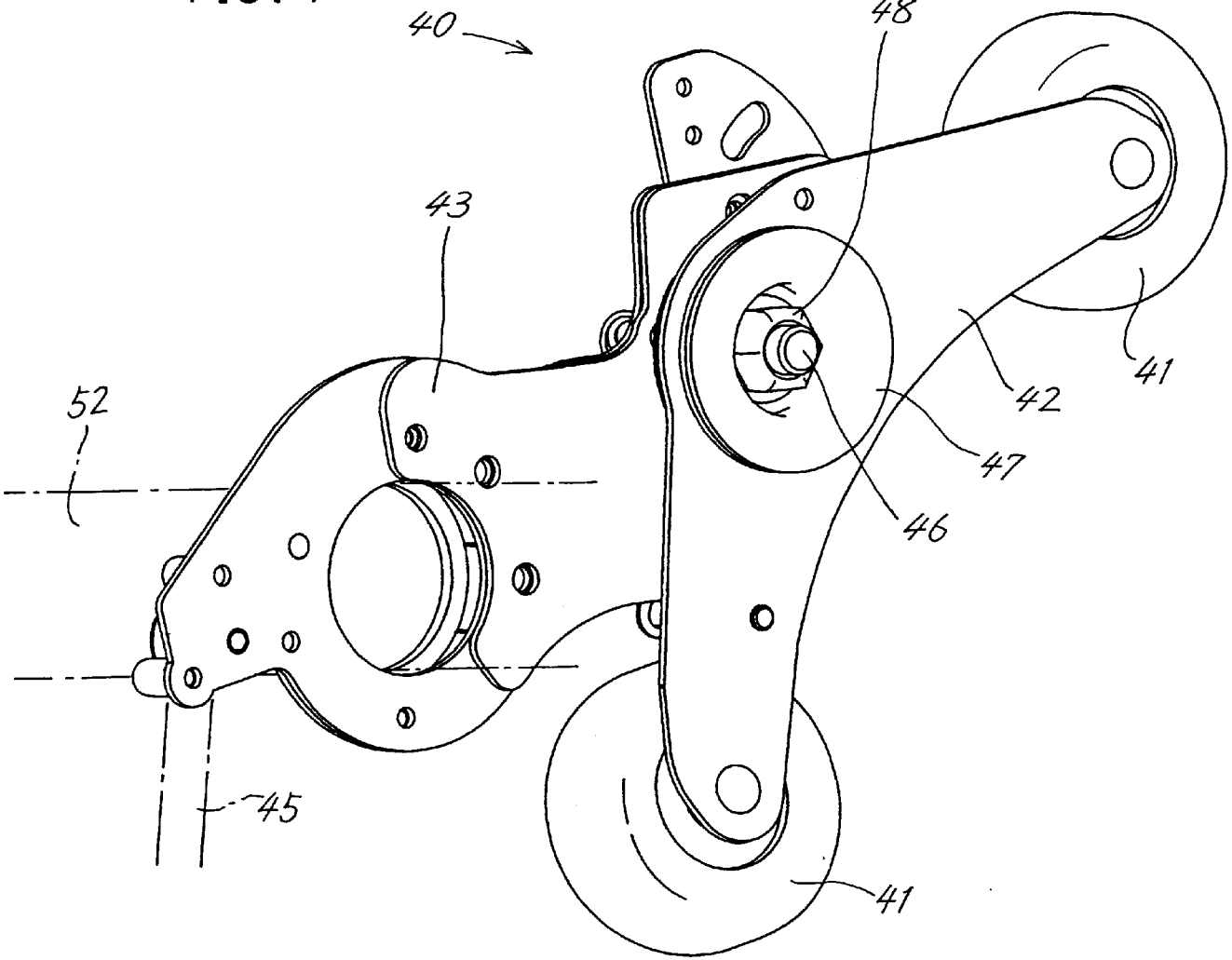
FIG. 4 is a perspective view of FIG. 3 as seen from the opposite side.
Figure 5:
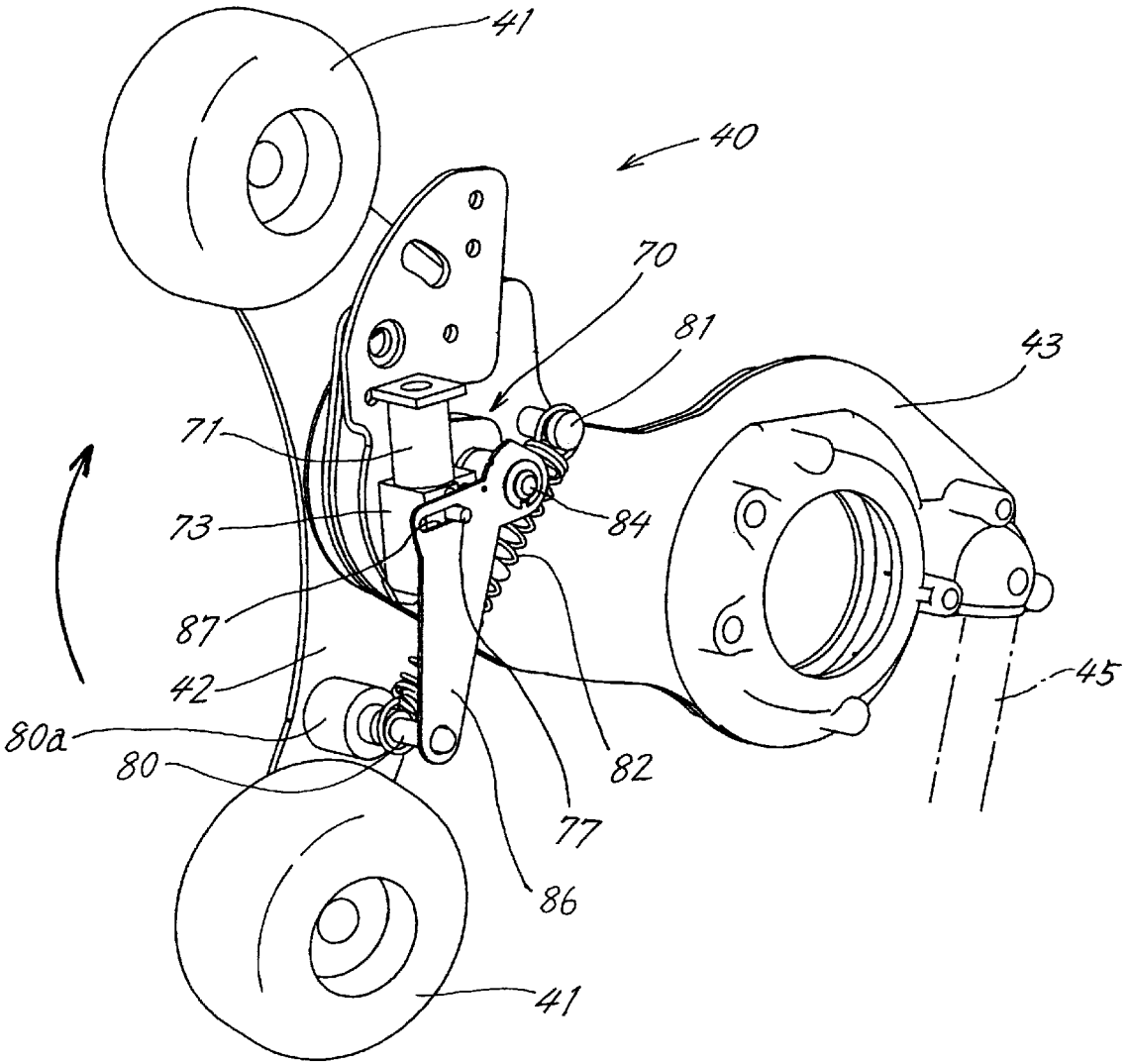
FIG. 5 is a perspective view showing one of the massage members of the invention on an enlarged scale, with kneading balls in a generally vertical arrangement.

As shown in FIGS. 3 to 5, the massage members 40, 40 each comprise a massage or finger arm 42 in the form of a plate bent at the midportion thereof at an obtuse angle and provided with a pair kneading balls 41, 41 respectively at its upper and lower ends. The arm 42 is pivoted at the bent portion to a pivotal arm 43. The massage arm 42 and the pivotal arm 43 are provided with the body outline measuring means 70 for measuring the body outline of the person to be massaged. The massage fingers 40, 40 will be described later along with the means 70.

The pivotal arms 43 are rotatably supported by the kneading means 50. A connecting rod 45 is attached by a ball joint 44 to the rear end of each pivotal arm 43, and is connected to the tapping means 60.

The kneading means 50 comprises a kneading shaft 52 for supporting the pivotal arms 43, 43 in an inclined position, and a kneading motor 51 for rotating the shaft 52. The motor 51 has its operation controlled by the control means 100 (see FIG. 1) disposed at a suitable location. The power from the motor 51 is transmitted to the shaft 52 via a reduction mechanism 53.

The kneading shaft 52 has inclined shaft faces 55, 55, and the pivotal arms 43, 43 are rotatably fitted to the inclined shaft faces 55, 55 and each supported in a inclined state. The pivotal arms 43, 43 are connected each at one end thereof to the connecting rods 45, 45 by the ball joints 44, 44 and held out of rotation, so that when the kneading shaft 52 is rotated, the massage arms 42, 42 move leftward and rightward, moving the kneading balls 41 of each arm toward or away from those of the other arm repeatedly for reciprocating movement for kneading.

The tapping means 60 comprises a tapping shaft 62 for supporting the connecting rods 45, 45 of the massage members 40, 40 at eccentric positions 180 degrees out of phase with each other about the axis, and a tapping motor 61 for rotating the tapping shaft 62. The motor 61 has its operation controlled by the control means 100. The power from the motor 61 is delivered to the shaft 62 by way of a reduction mechanism 63.

When rotated, the motor 61 causes the connecting rods 45, 45 coupled to the tapping shaft 62 at eccentric positions to reciprocatingly move the massage members 40, 40 upward and downward to perform a tapping movement.

Body Outline Measuring Means 70

The body outline measuring means 70 will be described along with the massage member 40.

FIGS. 3 and 4 are perspective views of the left massage member 40 shown in FIG. 2, FIG. 3 shows the left massage member 40 as it is seen from inside, and FIG. 4 shows the left massage member 40 as seen from outside.

The massage member 40 comprises the pivotal arm 43 coupled to the kneading shaft 52 and tapping shaft 62, the massage or finger arm 42 pivoted to the outer end of the pivotal arm 43, and kneading balls 41, 41 supported by the upper and lower ends of the massage arm 42.

As shown in FIG. 4, the massage arm 42 is rotatably mounted by a resin bearing 47 on a support bolt 46 on the pivotal arm 43 and held to the bolt with a nut 48.

With reference to FIG. 3, the massage arm 42 and the pivotal arm 43 are provided with respective pins 80, 81, and a tension spring 82 extends between and engaged with the pins 80, 81 for holding the upper kneading ball 41 in an advanced position.

An elastic rubber 80*a* is fitted around the pin 80 on the massage arm 42 to serve as a stopper for holding the massage arm 42 in a forwardly inclined position by contact with the pivotal arm 43.

For example, the body outline measuring means 70 can be of such a mechanism which produces variations in voltage, current or resistance output value or output waveform when the two arms 42, 43 are pivotally moved relative to each other by the massage members 40, 40 coming into contact with the person to be massaged.

The measuring means 70 will be described below, for example, with reference to a mechanism comprising a hollow cylindrical coil 71 and a magnetic core 72 movable into or out of the coil 71, the core being movable in the coil 71 with the pivotal movement of the massage arm 42 for detecting the angular variations from inductance variations of the coil.

Figure 6:
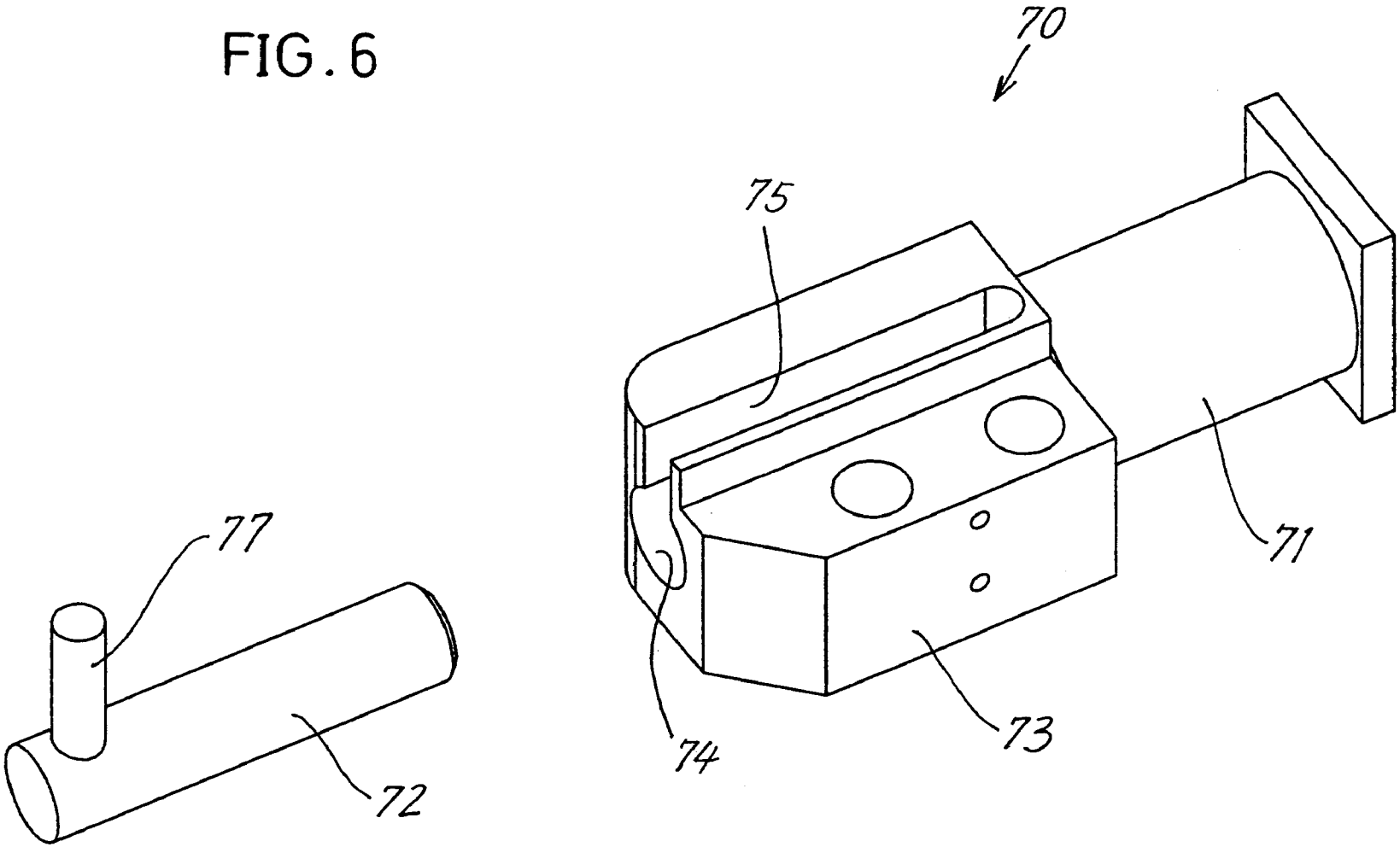
FIG. 6 is an exploded view of angle detecting means.

With reference to FIG. 6, the coil 71 comprises a hollow cylindrical coil bobbin 73 mounted on the pivotal arm 43 and a conductor wound around the bobbin 73. The bobbin 73 has an upper portion provided with the coil 71, and a lower portion provided with a guide bore 74 for slidably guiding the magnetic core 72 to be described below, and a guide groove 75 for a guide pin 77 projecting from the core 72 to move along. The guide bore 74 is in communication with the interior of the coil 71.

As shown in FIG. 6, the magnetic core 72 is in the form of a solid cylinder and slidably fitted in the guide bore 74 of the bobbin 73. The guide pin 77 provided at the lower end of the core 72 is loosely fitted in the guide groove 75.

Projecting vertically from the inner side of the pivotal arm 43 is a pivot 84 (see FIG. 3) generally coaxial with the support bolt 46 (see FIG. 4). The pivot 84 is coupled to the pin 80 on the massage arm 42 by a control plate 86. The control plate 86 is rotatably mounted on the pivot 84 and the pin 80.

Formed in the control plate 86 is a slot 87 extending radially of the pivot 84. The slot 87 has slidably fitted therein the pin 77 on the magnetic core 72.

The bobbin 73 is attached to the pivotal arm 43 at such a position that the magnetic core 72 fitted in the guide bore 74 is out of the coil 71 when the massage arm 42 is in its forwardly inclined position as seen in FIG. 3, and that the core 72 is brought into the coil 71 with the guide pin 77 moved to a position close to the upper end of the guide groove 75 when the upper and lower kneading balls 41, 41 on the massage arm 42 are positioned as arranged approximately vertically.

Operation of Body Outline Measuring Means 70

With reference to FIGS. 3 to 5, when the massage arm 42 is moved relative to the pivotal arm 43 so that the kneading balls 41, 41 are arranged generally vertically, the control plate 86 rotates with the massage arm 42, permitting the guide pin 77 to slidingly move along the slot 87 and pushing up the core 72 into the coil 71. Conversely when the massage arm 42 moves in a direction to return to the forwardly inclined position under the action of the tension spring 82 as seen in FIGS. 5 to 3, the magnetic core 72 slidingly moves out of the coil 71.

Thus, the pivotal movement of the massage arm 42 relative to the pivotal arm 43 reciprocatingly moves the core 72 into or out of the coil 71.

Figure 15:
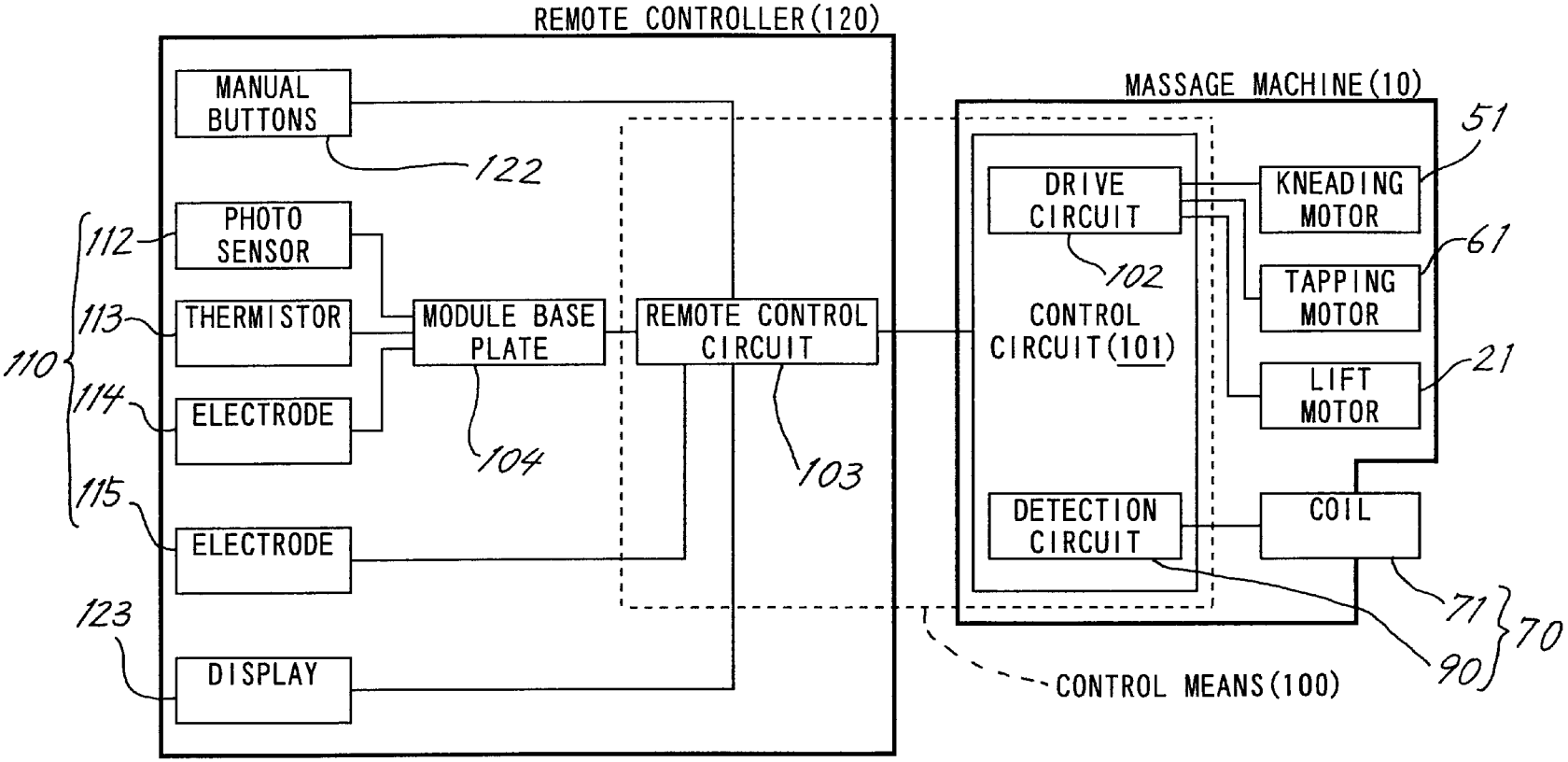
FIG. 15 is a block diagram showing the construction of electrical system of the massage machine and the remote controller of the invention.

As shown in FIG. 15, the coil 71 is connected to a detection circuit 90 included in the control means 100. A pulse current of predetermined frequency is fed to the coil 71 from the control means 100. With the movement of the magnetic core 72 into or out of the coil 71, the inductance of the coil varies, such that the angle of rotation of the massage arm 42 can be detected by measuring the voltage variation of the circuit.

Figure 7:
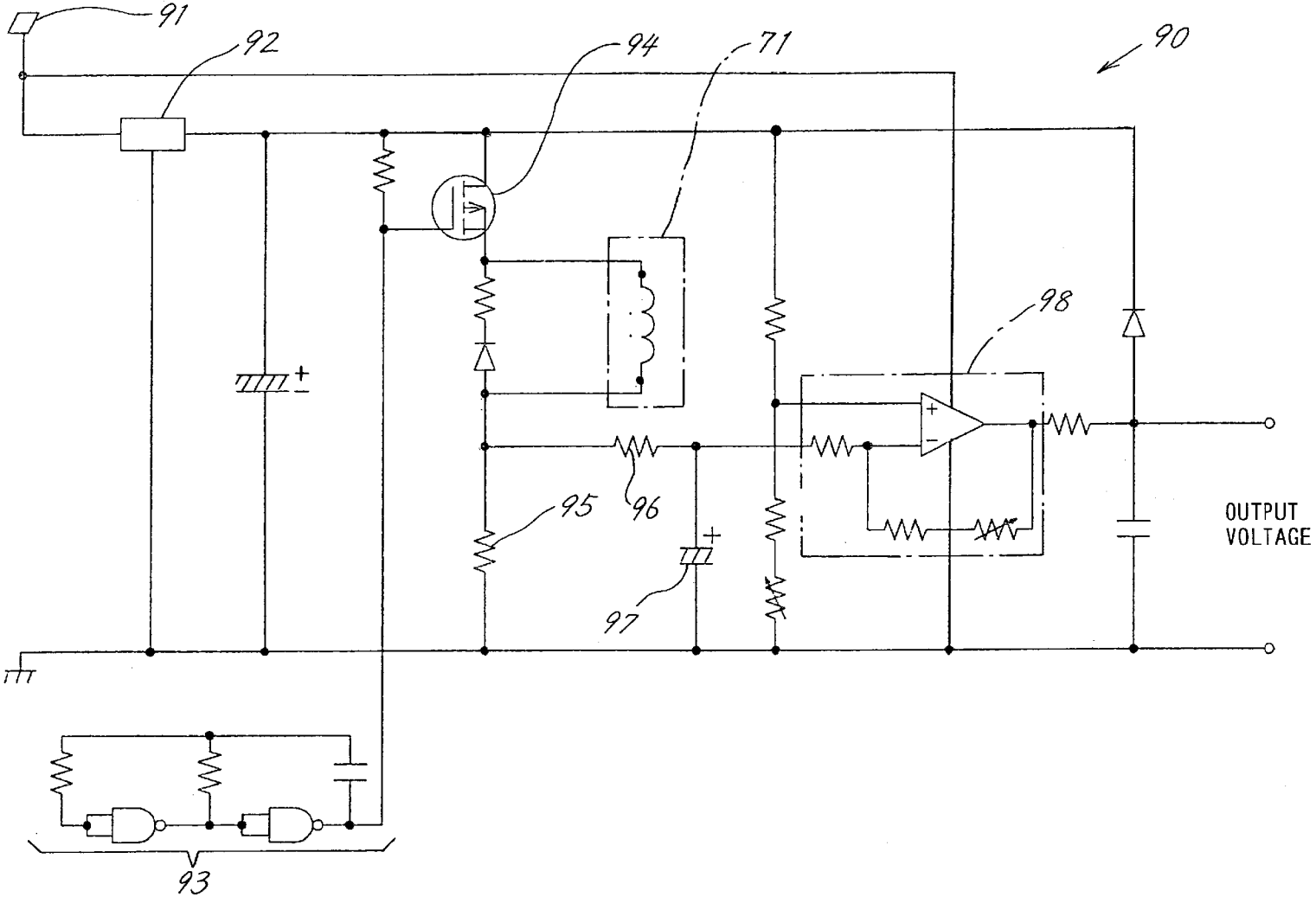
FIG. 7 is a diagram of a detection circuit.

FIG. 7 shows an example of detection circuit 90. The illustrated detection circuit 90 has a 12-V transformer secondary smoothing power source 91 which is reduced by a constant-voltage IC 92 to a constant voltage of 5 V, and an oscillation circuit 93 for producing pulse current of 100 kHz. The current is fed to a transistor 94. The transistor 94 is turned on and off at 100 kHz for oscillation. The coil 71 is connected to the emitter of the transistor 94. When the inductance of the coil 71 varies, the pulse peak voltage on a resistor 95 varies. The peak voltage is smoothed by a resistor 96 and a capacitor 97, amplified by a differential amplifier circuit 98 and thereafter delivered as an output voltage.

The particular body of the person to be massaged can be measured simultaneously with the measurement of physiological data by preliminary massage.

Measuring Body Outline

Figure 14:
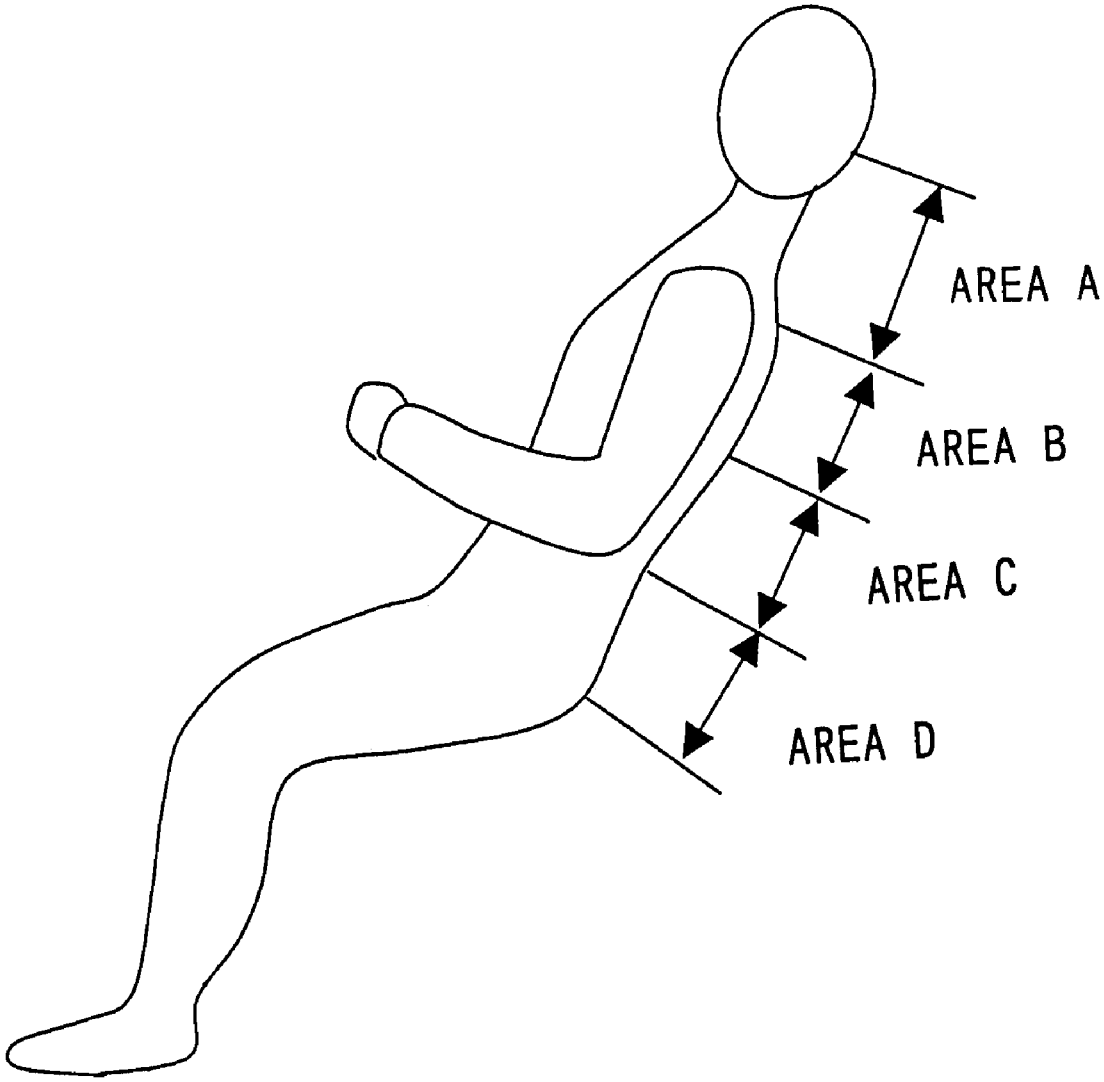
FIG. 14 is a diagram showing the upper half of the body of the person to be massaged as divided into areas A to D.

The part to be massaged of the person is divided, for example, into four areas as shown in FIG. 14, i.e., area A "neck, head," area B "shoulders," area C "back," and area D "waist." The control means 100 has stored therein in advance the magnitude and variations of voltage to be output from the detection circuit 90 for these areas. These values are compared with the magnitude and variations of voltage actually output from the detection circuit 90 in accordance with the opening angle between the arms 42, 43 and variations in the opening angle, whereby the particular area wherein the massage members 40, 40 are positioned is detected.

Figure 8:
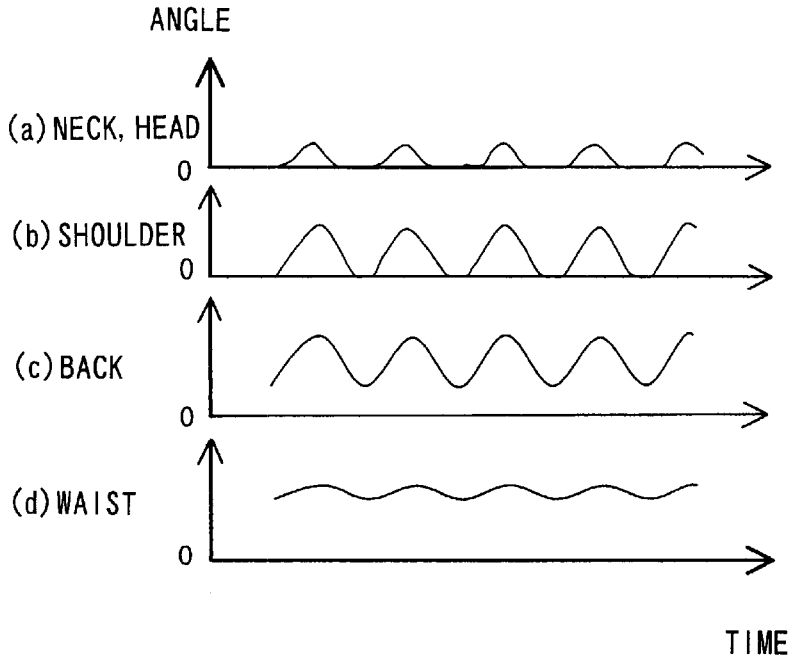
FIG. 8 includes graphs showing the angle of the massage arm relative to a pivotal arm and variations in the angle, as detected at different body parts.
Figure 9:
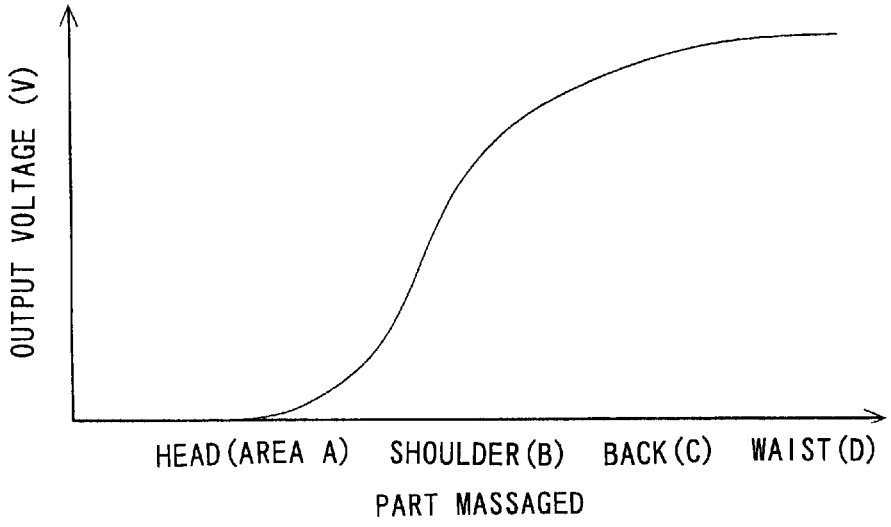
FIG. 9 is a graph showing voltage values output from a coil for the different body parts.

The relationship between the characteristics of the opening angle of the arms 42, 43 and angular variations thereof and the characteristics of output voltage involved in the individual areas will be described in detail. FIG. 8 shows the opening angle of the arms 42, 43 and variations therein in the respective massage areas which are given kneading massage by rotating the kneading motor 51. FIG. 9 shows the output voltage of the detection circuit 90 for the individual areas when the massage unit 30 moves from the head of the person massaged to his waist while giving preliminary massage.

The state in which the massage arm 42 is forwardly inclined to the greatest extent is referred to as 0°. When the kneading balls 41 are in contact with the neck or head of the person, the peak of the opening angle between the arms 42, 43 and variations in the angle are represented by a small waveform as seen in FIG. 8(*a*), and the output voltage value and variations in this value for the area of neck, head are almost zero as represented by the curve of FIG. 9.

When the kneading balls 41 are in contact with the shoulder of the person, the contact of the ball 41 with the ridgeline of the shoulder pushes the upper kneading ball 41 rearward, so that a great waveform representing great variations in the angle is obtained as shown in FIG. 8(*b*), and the curve shown in FIG. 9 indicates a medium output voltage and great variations for the area of shoulders.

When the kneading balls 41 are in contact with the back, the opening angle between the arms 42, 43 are great and varies greatly as shown in FIG. 8(*c*). The great opening angle is attributable to the rise of the balls 41 to an almost vertical position, while the following is responsible for the great variations in the angle. When subjected to the pressure of the balls 41, 41 on the back, the person is forwardly inclined by being pushed into a forwardly bent posture, and with this change of the posture of the person, the massage arm 42 acts to return to the forwardly inclined position under the restoring force of the spring 82. As a result, the curve of FIG. 9 shows a great output voltage value and slightly great variations for the area of back.

Further when the kneading balls 41 are in contact with the waist, the opening angle of the arms 42, 43 is great, but variations in this angle are small as indicated in FIG. 8(*d*). The opening angle is great because massage is given with the kneading balls 41, 41 remaining in an approximately vertical position, while the variations in the angle are small because the pressure of the balls 41 acting on the waist still fails to bend the person forward. As a result, the output voltage value is great and involves little or no variations for the area of waist as shown in FIG. 9.

Thus, the part of the person massaged by the members 40, 40 can be located by the body outline measuring means 70. The part to be massaged, which differs from person to person, can be divided into four areas (A to D) as shown in FIG. 14. The number of divided areas is not limited to four, while the machine may be provided with means (not shown) for giving massage to the hips, thigh and calves, and these areas can be included in the part to be divided for measurement.

Physiological Data Measuring Means 110

The physiological data measuring means 110 is adapted to measure physiological data as to the person to be massaged, such as pulse, skin temperature and electrical resistance of the skin. The following description is given with reference to a case wherein such data is measured from the finger of the person, whereas physiological data can be measured from the palm of the person, or from the head, chest, wrist or the like. The term "physiological data" as used herein refers to physiological quantities which vary with the degree of stiffness or relaxation when the person is massaged. Examples of such quantities are brain waves, breathing rate, blood pressure, etc., in addition to pulse, etc. already mentioned.

Figure 10:
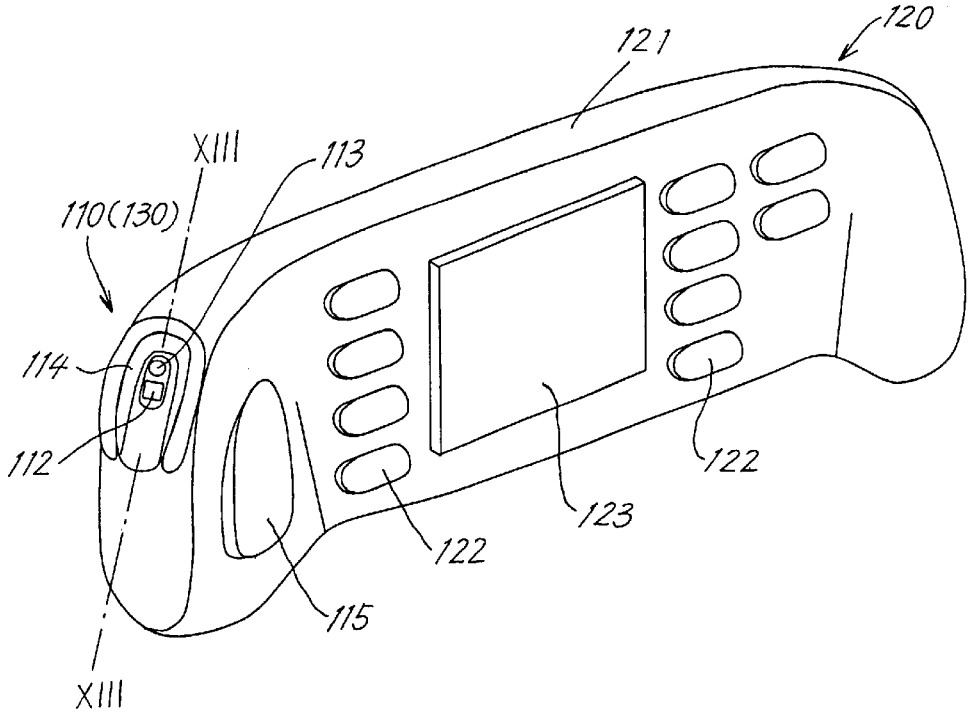
FIG. 10 is a perspective view of a remote controller.

The physiological data measuring means 110 can be provided in a remote controller 120 for manipulating the massage machine 10 as shown in FIG. 10.

The remote controller 120 has a case 121 which can be held by both hands of the person to be massaged. The case 121 has manual buttons 122, 122 for giving various commands to the massage machine 10, a display 123 for showing the operating state of the massage machine 10, and the physiological data measuring means 110.

With reference to FIG. 15, disposed inside the case 121 is a remote controller circuit 103 for controlling the buttons 122, 122, display 123 and physiological data measuring means 110 and processing the data obtained. The circuit 103 is electrically connected to a control circuit 101 disposed in the massage machine 10 as shown in FIG. 15.

Figure 11:
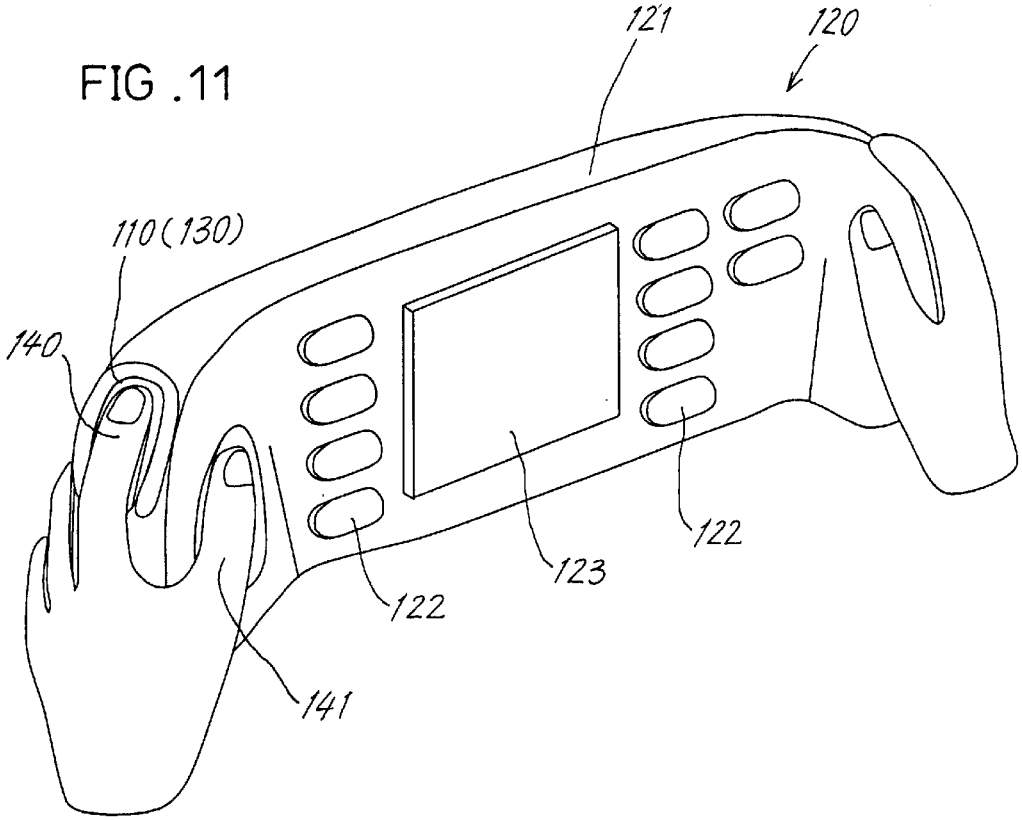
FIG. 11 is a perspective view showing the remote controller as grasped by the hands of the person to be massaged.

With reference to FIG. 10, the physiological data measuring means 110 comprises a photosensor 112 for measuring the pulse rate of the person to be massaged, a thermistor 113 for measuring the skin temperature, and a pair of electrodes 114, 115 for measuring the electrical resistance of the skin. As shown in FIG. 11, a measuring module 130 comprising the photosensor 112, thermistor 113 and electrode 114 is disposed on the case 121 at a left upper wall portion thereof with which the left hand index finger 140 comes into contact when the person to be massaged grasps opposite sides of the remote controller case 121 with his hands. The other electrode 115 is disposed at a front wall left side portion of the case 121 where the left hand thumb 141 comes into contact with the case.

Figure 12:
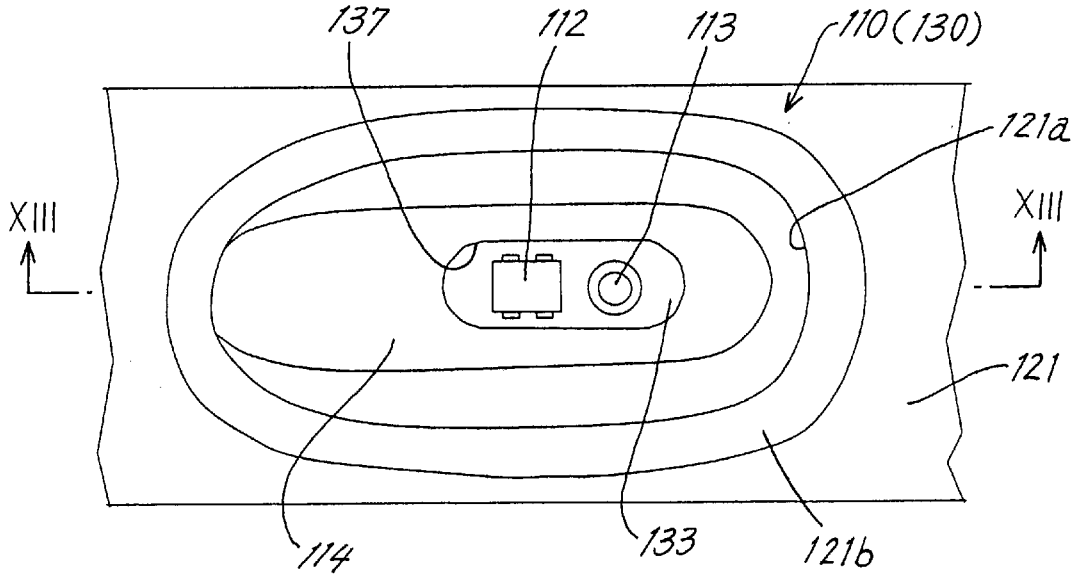
FIG. 12 is a plan view of a measuring module.
Figure 13:
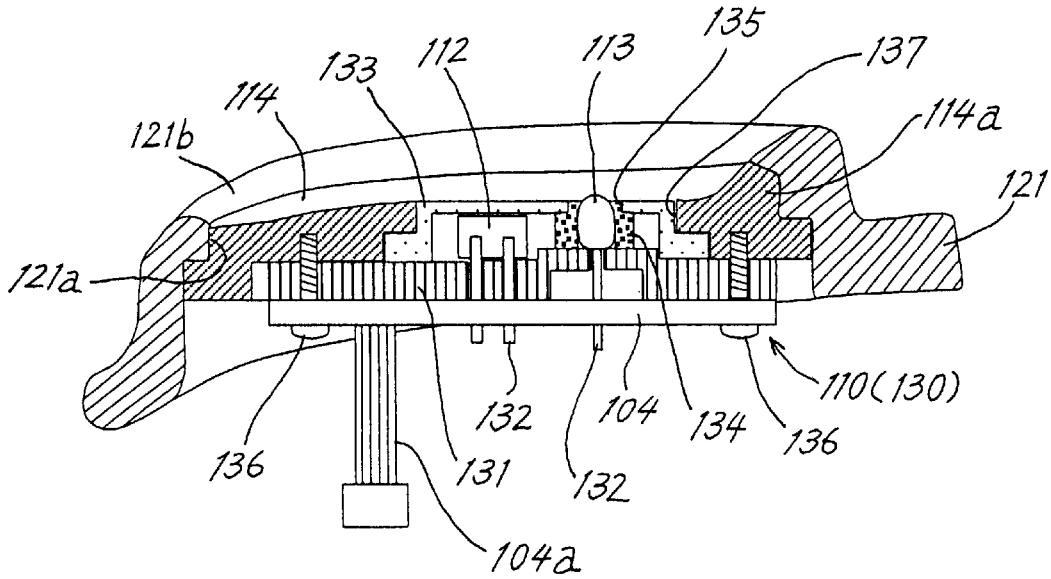
FIG. 13 is a view in section taken along the line XIII—XIII in FIG. 12.

FIG. 12 is a plan view of the measuring module 130, and FIG. 13 is a view in section taken along the line XIII—XIII in FIG. 10 or 12. An opening 121*a* is formed in the left upper wall portion of the case 121, with the measuring module 130 fitted in the opening 121*a*. The outer peripheral wall of the case defining the opening 121*a* is partly bulged to provide an edge portion 121*b* for protecting the measuring means 112, 113, 114 of the module 130 against damage due to direct contact with the floor or the like. The module 130 has the physiological data measuring means 110, i.e., the photosensor 112, thermistor 113 and electrode 114.

With reference to FIG. 13, the electrode 114 comprises a resin molding 114*a* plated with an electrically conductive metal over the surface thereof. The electrode is attached to the case 121 so as to be exposed to the outside from the opening 121*a*. The electrode 114 is centrally provided with a slot 137 and has a recess around the slot 137 for the tip of the index finger 140 to fit in. The electrode 114 is electrically connected to a module base plate 104 which will be described below.

As shown in FIG. 13, the photosensor 112 and the thermistor 113 are supported by a support member 131 on the module base plate 104 and have leads 132, 132 extending through the member 131. The lower ends of the leads 132, 132 are electrically connected to the base plate 104.

The photosensor 112 is disposed close to the inner side of a transparent cover 133 provided over the slot 137 of the electrode 114. The thermistor 113 can be one having an epoxy resin covering provided around a temperature measuring portion thereof. The epoxy resin covering is surrounded by a soft seal material 134 except at the outer end of the covering, with this end exposed directly to the outside through a hole 135 formed in the transparent cover 133. The module base plate 104 and the support member 131 are fastened to the resin molding 114*a* of the electrode 114 from inside with screws 136, 136 extending through the plate and the member.

Leads 104*a* for transmitting therethrough the data from the photosensor 112, thermistor 113 and electrode 114 extend from the module base plate 104 as seen in FIG. 13. As shown in FIG. 15, the photosensor 112, thermistor 113 and electrode 114 are electrically connected to the remote control circuit 103 through the module base plate 104.

The other electrode 115 also comprises a resin molding coated with an electrically conductive metal plating. The electrode 115 is attached to the front wall left side portion of the case 121 where the left hand thumb 141 comes into contact with the case. This electrode 115 is similarly electrically connected to the remote control circuit 103.

Control Means 100 The control system for the massage machine 10 of the foregoing construction will be described. The control means 100 has the control circuit 101 for controlling the massage machine 10, and the remote control circuit 103 for controlling the remote controller 120 as shown in FIG. 15. These circuits 101 and 103 are electrically connected.

The control circuit 101 has a drive circuit 102 for controlling the kneading motor 51, tapping motor 61 and lift motor 21, the detection circuit 90 of the body outline measuring means 70 described, and a memory (not shown) for storing various massage programs, etc.

The manual buttons 122, 122, display 123 and electrode 115 are connected to the remote control circuit 103. The photosensor 112, thermistor 113 and electrode 114 are also connected to the remote control circuit 103 via the module base plate 104. The remote control circuit 103 transmits a manipulation command from the manual button 122 to the control circuit 101 of the massage machine 10, shows the state of massage, results obtained by the measuring means 70, 110, etc. on the display 123, and further processes the results of measurement by the physiological data measuring means 110.

Preliminary Massage

When the person to be massaged places his left hand index finger 140 on the module 130 while grasping the remote controller 120 with his hands for preliminary massage, the tip of the index finger 140 spontaneously comes into contact with the electrode 114, and the photosensor 112 and the thermistor 113 provided in the central recess of the electrode 114, with the left hand thumb 141 in intimate contact with the electrode 115 on the front wall of the case 121.

When the machine is initiated into preliminary massage, the physiological data measuring means 110 is started up for the detection of various items of physiological data.

The photosensor 112 emits infrared rays from a light-emitting element toward the index finger 140 and detects the rays with a photodetector upon reflection at the finger for measuring the variation of blood flow rate produced by the pulse from the quantity of reflected light. The measured pulse rate is transmitted to the remote control circuit 103.

The thermistor 113 measures the temperature of the skin of the index finger 140 and transmits the measurement to the remote control circuit 103.

A constant voltage is impressed across the electrodes 114, 115, and the current value between the index finger 140 and the thumb 141 is measured. Electrical resistance between the index finger 140 and the thumb 141 is calculated from the current value, and the result is sent to the remote control circuit 103.

During the preliminary massage, items of physiological data, i.e., the pulse rate, skin temperature and electrical resistance of the skin, are measured at a predetermined time interval (e.g., every second) along with the determination of area by the body outline measuring means 70, and the degree of stiffness of the person at different areas is judged.

When the part of low stiffness is massaged, the person massaged is brought into a relaxed state, generally showing a drop in pulse rate and a rise in skin temperature and in skin electrical resistance. Conversely, if the part of great stiffness is massaged, the person becomes tense, exhibiting a rise in pulse rate and a drop in skin temperature and skin electrical resistance. Thus the pulse rate increases or decreases in reverse relation with the skin temperature and skin electrical resistance.

To explain sensitivity levels T, S and stiffness levels U, V below for a better understanding, the reciprocals of values of skin temperature and skin electrical resistance will be used as measurements of these data.

As an example of measurement of the degree of stiffness, the tendency T of the variation of each item of physiological data measured for each part, and the variation S of this particular data (each will hereinafter be referred to as the "sensitivity level") are calculated from Equations 1 and 2 given below, the stiffness level U in accordance with the kind of physiological data is calculated from the item of data and the sensitivity levels T, S. An overall stiffness level V can be derived by generalizing the stiffness levels U thus obtained for the various kinds of data.

Figures 16, 17:
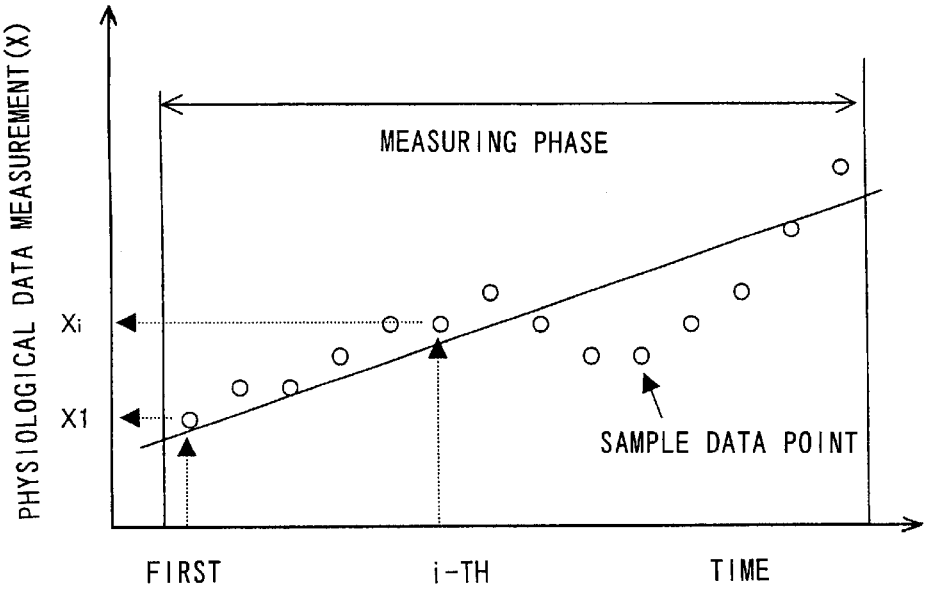
FIG. 16 is a graph showing measurements of physiological data.
FIG. 17 is a table showing a physiological reaction sheet.

The sensitivity level T showing the tendency of variation indicates an increase or decrease in each of various items of physiological data (reciprocals for the skin temperature and skin electrical resistance) at each of various areas as shown in FIG. 16. The sensitivity level T is a value determined from Equation 1 to be described below.

A small sensitivity level T indicates a state in which the part of low stiffness is massaged, meaning that the body is relaxed. Conversely, a great sensitivity level T indicates a state in which the part of great stiffness is massaged, meaning that the body is tense.

The sensitivity level T can be expressed by a score of 0, 1 or 2. The smaller the score, the more relaxed the person massaged.

Stated more specifically, N items of physiological data obtained for each area are plotted on a graph, linear correlation interpolation is done, correlation coefficient a is calculated from Equation 1 below, the correlation coefficient a obtained is compared with a predetermined threshold value a0, and the sensitivity level T is calculated as score 2 when a>a0, as score 1 when $-a0 \leqq a \leqq a0$, or as score 0 when $a<-a0$. The result is written in a physiological sheet as shown in FIG. 17. In Equation 1, Xi is an i-th value of physiological data measured.

$$a = \frac{N\sum^{N} iX_i - \sum^{N} i \sum^{N} X_i}{N\sum^{N} i^2 - \left(\sum^{N} i\right)^2} \qquad \text{Equation 1}$$

The sensitivity S indicating the variation of each of items of physiological data (similarly reciprocals for the skin temperature and skin electrical resistance) represents the magnitude of variation of physiological data in each area. The sensitivity level S is a value calculated from Equation 2 described below.

Like the sensitivity level T described, a small sensitivity level S indicates a state in which the part of low stiffness is massaged, meaning that the body is relaxed. Conversely, a great sensitivity level S indicates a state in which the part of great stiffness is massaged, meaning that the body is tense.

The sensitivity level S can be expressed by a score of 0, 1, 2 or 3. The smaller the score, the more relaxed the person massaged.

Stated more specifically, N items of physiological data obtained for each area are plotted on a graph, variation coefficient b is calculated from Equation 2 below, the variation coefficient b obtained is compared with three predetermined threshold values b1, b2 and b3, and the sensitivity level S is calculated as score 0 when $0<b \leqq b1$, as score 1 when $b1<b \leqq b2$, as score 2 when $b2< \leqq b3$, or as score 3 when $b3<b$. The result is written in the physiological sheet as shown in FIG. 17. In Equation 2, Xi is an i-th value of physiological data measured.

$$b = \frac{\sum^{N-1} |X_{i-1} - X_i|}{N-1} \qquad \text{Equation 2}$$

The sensitivity levels S, T are calculated for different kinds of physiological data for each of the areas A to D, and the stiffness level U representing the degree of stiffness of each area for each kind of physiological data is calculated. The stiffness level U is a value calculated from Equation 3 given below.

A small stiffness level U indicates a state in which the part of low stiffness is massaged, meaning that the body is relaxed. Conversely, a great stiffness level U indicates a state in which the part of great stiffness is massaged, meaning that the body is tense.

The stiffness level U can be expressed by the sum of the sensitivity levels T and S. The smaller the sum, the more relaxed the person massaged.

Stated more specifically, the sensitivity levels T and S obtained above are multiplied by predetermined coefficients α and β, respectively, the sum of the products is calculated to obtain a stiffness coefficient c, the coefficient is compared with two predetermined threshold values c1, c2, and the stiffness is interpreted as being low when $c \leqq c1$, as being ordinary when $c1<c \leqq c2$ or as being great when $c2<c$.

$$c = \alpha a + \beta b \qquad \text{Equation 3}$$

For a simplified description, suppose α and β are each 1. The stiffness coefficient representing the stiffness level U is calculated as an integer of 0 to 5 as shown in the physiological reaction sheet of FIG. 17 for each of the areas A to D. Assuming that the threshold value c1 is 1 and that the threshold value c2 is 3, a stiffness coefficient of up to 1 indicates low stiffness, the stiffness is ordinary if $1<c\leqq 3$, and the stiffness is great if $3<c$.

For example in area A (neck, head), the sensitivity level T representing the tendency of variation in pulse is 0, and the sensitivity level S indicating the variation is 2, so that the stiffness level U is 2, and the part of the neck, head is judged to be ordinary in stiffness from the pulse data. In area B (shoulders), the sensitivity level T for pulse is 2, and the sensitivity level S is 2, so that the stiffness level U is 4, indicating that the stiffness of the shoulder is great when judged from the pulse.

The stiffness levels in various areas for various items of physiological data calculated similarly are shown in FIG. 17.

Since the present embodiment utilizes three kinds of physiological data, the overall stiffness level V is judged from stiffness levels U derived from these three kinds of data. The overall stiffness level V can be calculated as the sum of stiffness levels U calculated for the respective areas. The overall stiffness levels V calculated are also shown in the physiological reaction sheet of FIG. 17. The calculated stiffness levels are classified according to predetermined threshold values. For example, the stiffness is low when the overall level V is up to 5, or ordinary when the level V is 6 to 11, or great if the level V is at least 12.

With reference to FIG. 17, in respect of the overall stiffness level V, areas A and D are ordinary in stiffness, while area B is great in stiffness, and area C is low in stiffness.

For preliminary massage, the person to be massaged pushes the desired manual button 122 on the remote controller 120 to select a massage course based on the body outline and physiological data, and the controller 120 is grasped with both hands, whereby the preliminary operation is started.

This operation measures the body outline and physiological data, a physiological reaction sheet is prepared by carrying out various calculations, and the overall stiffness levels V are calculated. After the levels V are obtained, a full massage process is determined based on the levels V.

The main or full massages is given with varying intensities to various areas in accordance with the overall stiffness levels V. For example, for an area which is found to be great in stiffness (at least 12 in overall stiffness level V), both kneading and tapping are performed at the same time in combination with an intense massage, e.g., with a rolling massage. Kneading or tapping is performed in combination with a medium massage, e.g., a rolling massage, on an area which is found to be ordinary in stiffness (6 to 11 in overall stiffness level V). A rolling massage only is given without kneading or tapping to an area which is found low in stiffness (up to 5 in overall stiffness level).

Thus, intense massage is given to the part of great stiffness and weak massage to the part of low stiffness in accordance with the stiffness of the person to be massaged, consequently performing an effective massage without causing the person to feel unsatisfactory or any pain to relax him.

Although the main massage operation has been described above for removing stiffness from the person to be massaged and allowing the person to feel relaxed, the person can be so massaged as to feel aroused conversely to the relaxed state in accordance with the overall stiffness level V. Although the embodiment described is adapted to perform before the main massage a preliminary massage to measure the overall stiffness levels V first by the body outline measuring means 70 and physiological data measuring means 110 and determine the main massage process, the body outline and physiological data can be measured during the main massage operation to determine he overall stiffness levels and feed back the result to the control system for the correction of the massage process during massaging. This provides a massage producing a further improved effect.

The body outline measuring means 70 and the physiological data measuring means 110 are not limited to the foregoing embodiment in construction or position of installation.

Although the foregoing embodiment uses three items of physiological data, the number of data items to be utilized is not limited to three but a smaller or larger number of items of data can be used.

The method of judging the degree of stiffness or relaxation is of course not limited to the above calculation method based on sensitivity levels and stiffness levels.

The present invention can be modified or altered by one skilled in the art without departing from the spirit of the invention. Such a modification or alteration is included within the scope of the invention as set forth in the appended claims.

What is claimed is:

1. A massage machine comprising:

massage members for performing massage along the body of the person to be massaged, control means for controlling the movement of the massage members, body outline measuring means electrically connected to the control means and for measuring body outline of the person, physiological data measuring means electrically connected to the control means and for measuring physiological data produced by massaging the person, said control means being operative to divide the body to be massaged into a plurality of areas on the basis of measurements obtained by the body outline measuring means, and operative to judge a degree of stiffness at each of the areas on the basis of a variation and a varied tendency of the physiological data obtained by the physiological data measuring means, whereby the movement of the massage members can be controlled according to the degree of stiffness at each area of the body.

2. The massage machine according to claim 1 wherein the body outline of the person detected by the body outline measuring means based on angular variations of the massage members.

3. The massage machine according to claim 1 wherein the physiological data measuring means measures at least one selected from among pulse rate of the person, skin temperature of the person, and skin electrical resistance of the person.

4. The massage machine according to claim 1 wherein the physiological data measuring means measures the physiological data from at least one selected from among a palm of the person and a finger of the person.

5. The massage machine according to claim 1 wherein the control means divides the body of the person to be massaged into a plurality of parts from the result of detection by the body outline measuring means, and the physiological data of the person is measured by the physiological data measuring means for each of the divided parts.

* * * * *